United States Patent [19]

Bombardieri

[11] 4,130,163

[45] Dec. 19, 1978

[54] METHOD FOR RECOVERING VISCOUS HYDROCARBONS UTILIZING HEATED FLUIDS

[75] Inventor: Caurino C. Bombardieri, Calgary, Canada

[73] Assignee: Exxon Production Research Company, Houston, Tex.

[21] Appl. No.: 837,114

[22] Filed: Sep. 28, 1977

[51] Int. Cl.[2] ..... E21B 43/24

[52] U.S. Cl. ..... 166/252; 166/263; 166/272

[58] Field of Search ..... 166/272, 263, 245, 303, 166/252

[56] References Cited

U.S. PATENT DOCUMENTS

| | | | |
|---|---|---|---|
| 3,259,186 | 7/1966 | Dietz | 166/263 |
| 3,280,909 | 10/1966 | Closmann et al. | 166/263 |
| 3,393,735 | 7/1968 | Altamira et al. | 166/245 |
| 3,805,892 | 4/1974 | Haynes, Jr. | 166/245 |
| 3,872,922 | 3/1975 | Altamira et al. | 166/245 |

*Primary Examiner*—Stephen J. Novosad

*Attorney, Agent, or Firm*—D. A. Roth; M. A. Nametz

[57] ABSTRACT

A multi-phase heated fluid process which avoids heated fluid breakthrough, is used to continually produce subsurface hydrocarbons, utilizing two commmunicating wells in a process comprising:

simultaneous injection of said heated fluid into said wells until substantial mobilization of hydrocarbons within a zone surrounding said wells is obtained; one well is shut in while production is commenced in the other well;

preferably a final phase where sufficient heated fluid at relatively restricted rates is continually injected into said one well to provide driving force for continual production in said other well, without interruption, once production has commenced.

5 Claims, 4 Drawing Figures

STAGES OF IMPROVED RECOVERY METHOD OF HEAVY OIL RESERVOIRS

METHOD FOR RECOVERING VISCOUS HYDROCARBONS UTILIZING HEATED FLUIDS

CROSS REFERENCE TO RELATED APPLICATIONS

There are no other formal applications related to this one.

BACKGROUND OF THE INVENTION

1. Field of the Invention

This invention relates to a process for extracting hydrocarbons from the earth. More particularly, this invention relates to a method for recovering especially viscous hydrocarbons e.g. bitumen from a subterranean formation using at least two wells for injection and production, and which includes critical manipulative steps with heated fluid.

2. Description of the Prior Art

In many areas of the world, there are large deposits of viscous petroleum, such as the Athabasca and Peace River regions in Canada, the Jobo region in Venezuela and the Edna and Sisquoc regions in California. These deposits are generally called tar sand deposits due to the high viscosity of the hydrocarbons which they contain, and may extend for many miles and occur in varying thickness of up to more than 300 feet. Although tar sands may lie at or near the earth's surface, generally they are located under a substantial overburden which may be as great as several thousand feet thick. Tar sands located at these depths constitute some of the world's largest presently known petroleum deposits.

The tar sands contain a viscous hydrocarbon material, commonly referred to as bitumen, in an amount which ranges from about 5 to about 20 percent by weight. Bitumen is usually immobile at typical reservoir temperatures. For example, at reservoir temperatures of about 48° F., bitumen is immobile, having a viscosity frequently exceeding several thousand poises. At higher temperatures, such as temperatures exceeding 200° F., bitumen generally becomes mobile with a viscosity of less than 345 centipoises.

Since most tar sand deposits are too deep to be mined economically, a serious need exists for an in situ recovery process wherein the bitumen is separated from the sand in the formation and recovered through production means e.g. well drilled into the deposit.

In situ recovery processes known in the art include emulsification drive processes, thermal techniques (such as fire flooding), in situ combustion, steam flooding and combinations of these processes.

Any in situ recovery process must accomplish two functions: the viscosity of the bitumen must be reduced to a sufficiently low level to mobilize e.g. fluidize the bitumen under the conditions prevailing; and sufficient driving energy must be applied to that treated bitumen to induce it to move through the formation to a well or other means for transporting it to the earth's surface.

As previously noted, among the various methods that have been proposed for recovering bitumen in tar sand deposits are heating techniques. Because steam is generally the most economical and efficient thermal energy agent, it is clearly the most widely employed.

Several steam injection processes have been suggested for heating the bitumen. One method involves a steam stimulation technique, commonly called the "huff and puff" process. In such a process, steam is injected into a well for a certain period of time. The well is then shut in to permit the steam to heat the oil. Subsequently, formation fluids, including bitumen, water and steam, are produced from the well. Production is later terminated and steam injection is preferably resumed for a further period. Steam injection and production are alternated for as many cycles as desired. A principle drawback to the "huff and puff" technique is that it does not heat the bulk of the oil in the reservoir and consequently reduces the oil recovery.

Another method of recovering viscous petroleum materials from subterranean formations is through the use of thermal drive techniques. Typically, thermal drive techniques employ an injection well and a production well which extend into the reservoir formation. In operation, a hot fluid (usually steam) is introduced into the formation through the injection well. Upon entering the formation the hot flowing fluid lowers the viscosity of the petroleum materials therein and subsequently drives the lower viscosity fluid to a production well.

It has been found that conventional thermal drive processes generally are not commercially effective in recovering bitumen from tar sands. This stems from a basic problem in high viscosity hydrocarbon formations such as tar sands e.g. restricted fluid mobility in the reservoir. One reason for this is that the bitumen tends to cool and increase in viscosity as it moves away from the injection well where the steam or hot fluid is most effective. Once the bitumen attains a high enough viscosity, it banks up and forms an impermeable barrier to further flow toward production wells.

Another problem with steam drive is that the driving force of the steam flooding technique is ultimately lost when breakthrough occurs at the production well. Steam breakthrough occurs where the steam front advances to a production well and steam pressure is largely dissipated through the production well. Fluid breakthrough causes a loss of steam driving pressure characterized by a marked diminuation in the efficiency of the process. After steam breakthrough the usual practice, as suggested in U.S. Pat. No. 3,367,419 (Lookeren) and U.S. Pat. No. 3,354,954 (Buxton), is to produce without steam drive until further steam injection is necessitated or production terminated.

U.S. Pat. No. 3,259,186 (Dietz), for example, appears to have an early teaching of convention "huff and puff." The patent discloses a method for recovering viscous oil from subterranean formations by simultaneously injecting steam into an injection well to heat the formation. Formation fluids are then produced from the injection wells. After several cycles, steam drive can be established if several adjacent injection wells have been used by injecting steam into one injection well while using another for production. U.S. Pat. No. 3,280,909 (Closmann, et al) discloses a conventional steam drive comprising steam injection to produce interconnecting fractures, but insufficient to produce oil, followed by steam drive at conventional pressures and rates, e.g. considerably more than employed by the technique of the present invention. Thus, the heating and driving phases are entirely distinct. Moreover, the steam drive will result in breakthrough. Breakthrough is avoided in the instant invention.

While all of the above methods are of interest, the technology has not generally been economically attractive for commercial development of tar sands. There is a continuing need for an improved thermal system for effectively recovering hydrocarbons from subterranean formations such as tar sand deposits.

SUMMARY OF THE INVENTION

A hydrocarbon-containing formation, especially a highly viscous tar sand deposit, is penetrated by at least two wells. The wells are in actual or potential fluid flow and/or thermal communication with each other through said formation. Initially, a highly heated fluid, preferably steam, is simultaneously injected down both said wells into the formation, at relatively high pressures until said injected fluid heats a substantial zone within said formation sufficient to mobilize substantial quantities of hydrocarbons and establish said communication. Simultaneous injection into two wells avoids break through during injection because of pressure equalization in each well. Subsequently, one well is shut-in and formation hydrocarbons are produced from the other well because of the drive from said previously injected fluid. Production is monitored, and when it drops to a predetermined value, a heated fluid is again injected into the injection well, but this time at a selected restricted rate and pressure sufficient to cause formation fluids to continue to be produced from the production well at about the same rate but without breakthrough. The cycle can be repeated if desirable.

By practicing the method according to the invention, exceptionally viscous hydrocarbons are fluidized sufficiently to be induced to continually flow out of a formation. Moreover, novel advantages associated with avoidance of conventional steam breakthrough and cyclic operations are obtained.

DESCRIPTION OF THE PREFERRED EMBODIMENT

Figure 1:
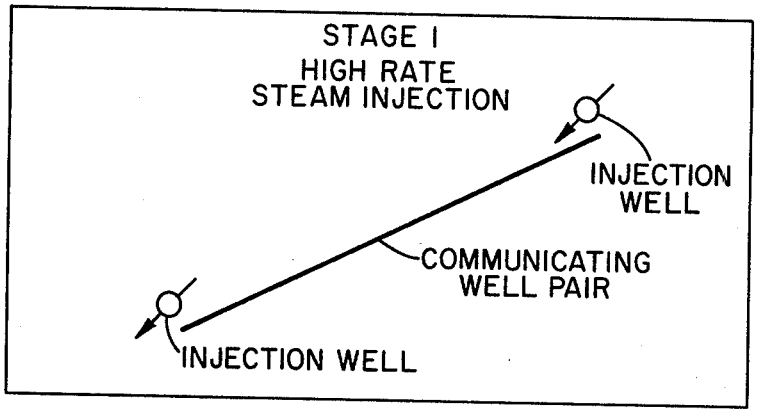
FIG. 1 is a diagrammatic representation of wells illustrating the state of two wells in the early stages of the process of this invention.
Figure 2:
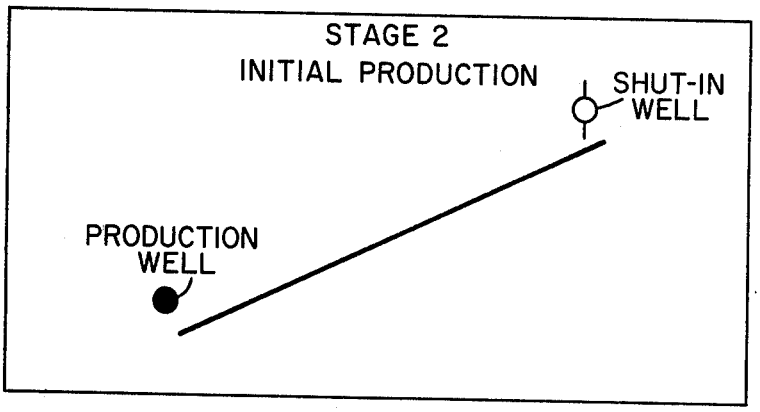
FIG. 2 is a diagrammatic illustration similar to FIG. 1 illustrating the process of the invention at a later stage.
Figure 3:
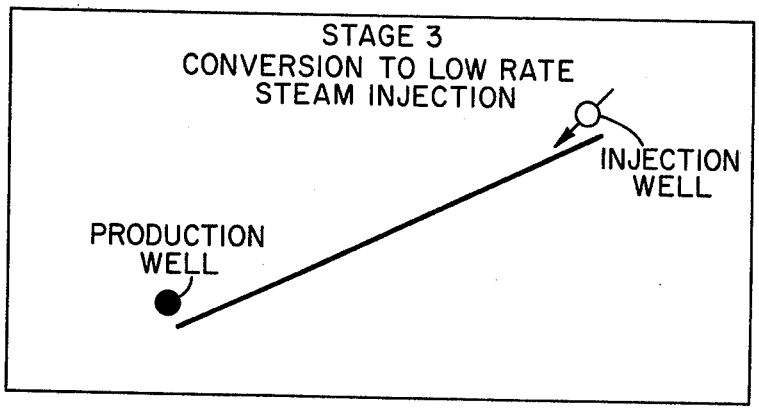
FIG. 3 illustrates a diagrammatic illustration similar to FIGS. 1 and 2 illustrating the process of the invention at still a later stage.

Referring to FIGS. 1–3 of the drawings, two wells are represented in varying phases of operation in the practice of the invention. The wells represented by a circle with a first quadrant arrow are injection wells; those which are solid circles are production wells, and those which are circles having a superimposed "X" mark are shut-in wells. While only two wells are illustrated in the drawings, it is to be understood that the invention is not limited to any particular number of wells.

A preferred embodiment of the invention is carried out in the following manner. Referring to FIG. 1, a heated fluid is simultaneously injected into an exceptionally viscous hydrocarbon formation through at least two wells in said formation. One well is referred to herein as an injection well and the other well is referred to herein as a production well. Although the hot fluid is preferably injected simultaneously down both the injection and production well, there can be situations where injection occurs at different times, as long as breakthrough of the heated fluids is not allowed to occur.

As will be described in more detail later, a number of fluids can be used in the practice of this invention; however, steam is especially preferred since it is most convenient to use. This embodiment will therefore be discussed in terms of steam although it is not so limited.

Steam is injected into the formation at an effective pressure regardless of the formation fracture gradient pressure, usually within the range of about 200 to about 2,500 psig, preferably 250 to 1,500, for initial injection (about 20 to 80, preferably 40 to 60, at most, preferably about 45 to 55 percent of the initial injected pressure when the formation is exposed to subsequent steam drive), and at a temperature within the range from about 200° F. to about 700° F., preferably about 375° F. to 626° F. Steam may be saturated or super-saturated.

Generally, in most field applications the steam will be saturated with a quality of approximately 65 to 90 percent. The quantity of steam injected will vary depending on the conditions existing at a given application.

Steam may be injected into tubing or annulus depending on capacity of the steam system and type of well completion. Ordinarily, steam is injected either through the casing or through the tubing with a packer set between tubing and casing above the pay. With the latter arrangement, heat losses, increases in casing temperature and resulting thermal stresses are minimized. The injection period varies between 5 and 300 days, depending on the permeability of the reservoir and the boiler capacity. Because of the many variables involved, treatment time is often determined through experience in a particular field.

There may also be employed an additional soak period of ¼ to 50, preferably 1 to 25, most preferably 1–10 days, after shutting-in both wells.

Since the rate of production after steam injection is a function of hydrocarbon viscosity, best results are obtained when the maximum amount of heat is injected in the shortest time. It is highly desirable, therefore, to inject steam into the reservoir at the highest temperature attainable to shorten the injection cycle and reduce heat losses in the well bore. And this should be at the fastest rates. Therefore, an injection rate of 1,000 to 100,000, preferably 25,000 to 50,000, lbs. of steam per hour is often satisfactory. Another way of expressing the injection rate is: 250 to 750 lbs. per foot of open interval in the well.

Several factors affect the volume of steam injection. Among these are the thickness of the hydrocarbon-containing formation, the viscosity of the oil, the porosity of the formation, amount of formation face exposed and the saturation level of the hydrocarbon and water in the formation. Generally, the total steam volume injected will vary between 5,000 and 250,000 barrels. Moreover, the steam may be mixed with other fluids e.g. gases or liquids such as water, to increase its heating efficiency. It may also be mixed with air and other oxygen containing gases to utilize a combustion front.

Because of its high heat content per pound, steam is ideal for raising the temperature of a reservoir. Saturated steam at 350° F. contains 1192 btu per pound compared with water at 350° F. which has only 322 btu per pound or only about one-fourth as much as steam. The big difference in heat content between the liquid and the steam phases is the latent heat or heat of evaporation. Thus, the amount of heat that is released when steam condenses is very large. Because of this latent heat, oil reservoirs can be heated much more effectively by steam than by either hot liquids or non-condensable gases.

Generally the formation should be heated radially at least 10 feet and up to 150 feet from each well bore. After the formation around the wells has been suitably heated, steam injection into the wells is discontinued.

Referring to FIG. 2, one of the injection wells is shut-in and the other well is placed on production. The removal of hydrocarbons from the formation via the production well may be accomplished by any of the known methods. The lifting of the hydrocarbons to the surface may be effected by pumping or gas lifting. The recovery apparatus is not described in detail because such production methods are well known.

During the period the well used subsequently for injection is shut-in, the pressure within that part of the formation which is in contact with the steam gradually reduces to a value which is lower than the fracture pressure of the formation.

After shut-in of one well, production will occur in the other for a period of time, albeit at declining rates over a given production cycle. When their producing rates decline below a predetermined value, the next step or phase can be instituted. This is an especially preferred embodiment of the invention. That is, a modified continuous drive phase is initiated.

It is initiated by introducing steam under relatively low pressure at the shut-in well.

The steam rate is chosen so that production rates tend to stabilize and so there is no interruption in production. Thus, the rate must be empirically determined to a large extent. But, in general, it is a rate that will promote reduced flow and the most favorable horizontal sweep performance.

Usually the rate of injection will not exceed the rate of fluid production (often they will be approximately equal to each other) and injection pressures will be below the fracture gradient pressures.

Also, the rate is chosen so as to avoid undue temperature rise. In this connection, the rate of steam injection in the drive phase will also depend on the amount of heat which is transferred from the hotter zone to the cooler zone and the fluid permeability of the formation between the two wells.

One aspect of the process of the invention is to achieve a low and continuous steam injection rate after shut-in of one well in the couple. The other is to avoid fluid (steam) breakthrough upon initial fluid injection. This is not an intermittent or cyclic injection mode.

Concomitantly, a balance between improved production and no steam breakthrough is maintained.

Thus, the thrust of the invention is that no steam breakthrough occurs, followed by continuous production.

By not operating in a steam breakthrough mode both at the start of production and throughout the production span or cycle, valuable heat and pressures are not dissipated from the reservoir by venting and greater total production is obtained with less energy expenditure.

It is to be noted that production rates may be lower over a cycle, but the cycle will be much longer than say a conventional "huff and puff" cycle.

Hydrocarbon fluids under the restricted drive of the invention flow more slowly through the communicating zone between the pair. This permits greater drainage, condensation, and capillary effects, thus resulting in a greater effective sweep area from the heated fluids.

There are considerable economic advantages stemming from employment of this invention. Thus, fewer pumps are required for production.

Moreover, steam is more efficiently utilized because low, continuous steam flow is less expensive than several intermittent injections with breakthrough.

It is desirable that pressure and temperature measuring devices be placed in the bottom of the injection well and the pressure and temperature recorded during this shut-in period. These pressure and temperature devices can be monitored to determine when the pressure has decreased sufficiently to indicate the proper time for commencing continued injection of low pressure steam at reduced rates into the formation. The actual oil production rates will be an additional factor in determining when low pressure fluid e.g. steam must be injected.

The term heated fluid, as used herein, is understood to mean a fluid having a temperature considerably higher e.g. 150° to 1,000° F. than the temperature of formation into which it is injected. It could be a heated gas or liquid such as steam or hot water and it could contain surfactants, solvents, oxygen, air, inert inorganic gases, and hydrocarbon gases.

Although the heated fluid in the initial and subsequent injection sequences described above were the same, i.e. steam, these fluids may differ. For example, the initially injected fluid may be steam and the second injected fluid may be hot water or vice versa. As a further example, the initial fluid may be hot water and the subsequent fluid may be super-heated steam. Any suitable agent for increasing the mobility of the viscous hydrocarbons may be added to the heated fluid.

The method of the present invention is not restricted to a particular well pattern, but can be employed in oil fields in which the wells are arranged according to previously existing patterns. The injection, shut-in and production periods for two equivalent sets of wells may coincide.

While this steam injection process is particularly suitable for thick deposits of heavy viscous hydrocarbons such as bitumen in tar sands, it should be understood that this invention may be employed to recover hydrocarbons of much higher API gravity, e.g. 25° to 40° API. Thus, it is also within the scope of this invention to imploy the method described herein to recover liquids from any substerranean strata which may be thermally stimulated.

ACTUAL FIELD EXAMPLE

This invention is further illustrated by referring to the following example based on a field test which is offered only as an illustrative embodiment of the invention and is not intended to be limited or restrictive thereof.

A tar sand formation is located at a depth of 1,000 feet and has a thickness of 75 feet. The hydrocarbon viscosity is so high that it is essentially immobile at the formation temperature which is about 55° F. The formation pressure is 450 psig and the in situ permability to the flow of water is 1000 millidarcies.

Two wells comprising a communicating well pair were completed into the tar sand deposit, one well being referred to as an injection well and the other referred to as a production well. The wells were spaced 460 feet from each other. Steam, at a temperature of about 575° F., was injected into the formation through both wells simultaneously for a period of about 40 days with the injection pressure averaging about 1000 psi at a rate of about 19,000 pounds/hour.

At the end of the 40-day injection period, injection of steam was terminated without breakthrough and one well was shut-in and the other well was opened for production. An initial production rate of 40 barrels per day of oil without steam breakthrough was obtained during the first week. Six months later, the production rate was about 65 barrels per day (bopd) and the pressure at the bottom of the shut-in injection well was 500 psig. When the pressure at the bottom of the injection well decreased to 450 psig and the producing rate declined to about 20 bopd, steam was again injected into the injection well at greatly restricted rates. Thus, steam was resumed at a temperature of about 475° F. with the injection pressure averaging about 550 psi. Recovery of fluids through the production well was continued until there was a significant increase in the water/oil ratio indicating that the reservoir being treated was depleted to a point where further production was no longer economically feasible.

Figure 4:
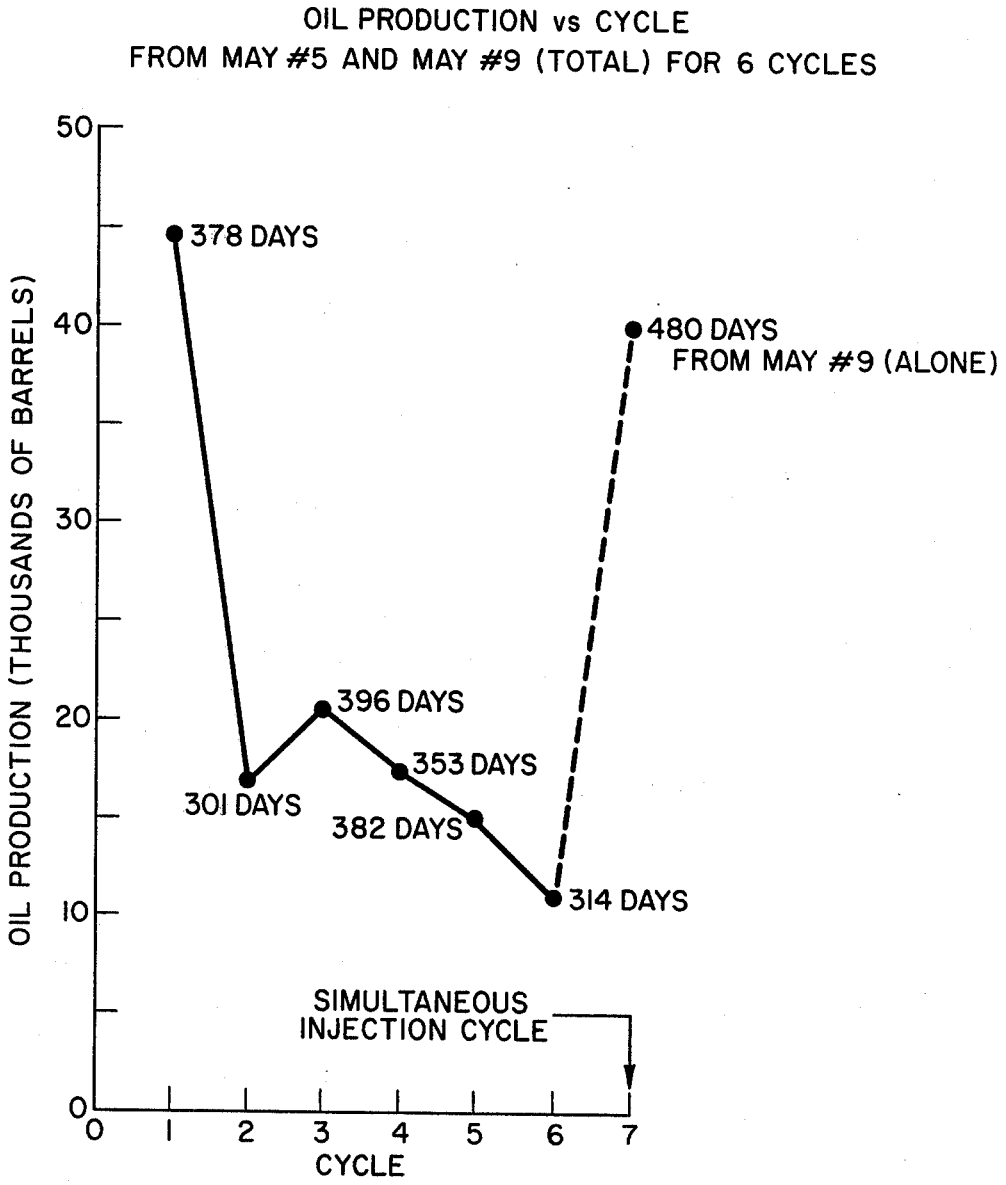
FIG. 4 is a graph of Production v. Cycle of an actual pair of wells.

The actual production performance of a pair of wells, May #5 and May #9, of May Pilot Cold Lake, Alberta, which were used as the field test for the invention is illustrated in the graph of FIG. 4.

These wells were in communication by the end of the first cycle and were treated with steam using a conventional "huff and puff" process for six cycles. The combined production from both May #5 and May #9, which started at 44,000 bbls for the first cycle, declined to 11,000 bbls for the sixth cycle. The performance for the seventh cycle, which is production after the simultaneous injection phase of the instant invention, shows an oil production of 40,000 bbls on July 1, 1977 from May #9 alone. A low rate of steam of 350 bpd at 300 psi is currently being injected into May #5 with no adverse effects such as high water-oil ratio, high temperature or steam break through at May 9. Flooding in the seventh cycle is in its 9th week at the time of this writing.

Thus, the date from the working examples demonstrates that this technique of the invention is extremely effective. It is especially noteworthy for enhanced recoveries of unexpectedly large dimensions even after extensive use of conventional enhanced recovery techniques, e.g. "huff and puff".

Accordingly, it is to be noted that a preferred embodiment of this invention is recovery enhancement after other conventional thermal techniques have apparently exhausted oil production potentiality.

The invention represents the only technique known to the inventor which is capable of achieving outstanding results in tar sands. Tar sands present exceptionally difficult and largely unsolved problems with respect to recovery at depths not capable of being mined by surface technology.

These tar sands generally have a relatively low temperature, 50°–125° F. and the oil contained within these sands has an extremely high viscosity at ambient conditions. Thus the viscosity may range from 1,000 to 100,000 centipoises, usually a mean viscosity exceeding 5,000 centipoises.

When the temperature of the tar sands is raised about one hundred degrees, the viscosity of the resulting fluid material, e.g. oil, can be reduced to 10 centipoises or less.

At such a low viscosity, it will readily flow and can be recovered by conventional production means.

Although the process of the invention utilizing the final phase, e.g. the restricted flow drive phase, is especially preferred, it is possible to achieve good results with just the dual injection and single recovery stage.

It will be apparent to those skilled in the art to select major process parameters which are suitable to the formations involved, using the teachings and guidelines set forth herein.

In general, steam injection rates, times, temperatures, etc., will be apparent to those skilled in the art.

The best technique for knowing when to commence the restricted drive phase of the invention process is to monitor and totalize all the fluids produced. Shortly before the total volume of fluid (converted to liquid state) equals that pumped into the wells, the initially restricted injection step into one well can generally be commenced.

Restricted drive will also be indicated where the oil/$H_2O$ ratio decreases substantially. In any event, restricted drive should be carried out at a point in time and in a manner to avoid breakthrough (usually indicated by a drastic change in heat, or water content of the produced fluid).

Usually the heated fluid will be injected at about the same rate as the rate of production of the produced fluid. But, it will be, as discussed above, at a considerably reduced rate as compared to that of the initial injection.

The initial steaming and production of newly drilled infill wells according to the example produces a very tight relatively high viscosity emulsion. In addition, there is some evidence of cross-trend flooding.

This suspected cross-trend flooding of newly drilled and steamed infill wells in heavy oil sands is improved by using the produced tight emulsion as a viscous bank ahead of an injection of low rate steam into steamed infill wells. The formed viscous emulsion will reduce fingering and improve the sweep performance of the low rate steam and the overall oil recovery.

The steamed infill wells would not be opened to production and the timing of the low rate steam injection would depend on the production performance of the adjacent producing wells as well as the pressure fall-off in the wells.

The principle of the invention and the best mode in which it is contemplated to apply that principle have been described. It is to be understood that the foregoing is illustrative only and that other means and techniques can be employed without departing from the true scope of the invention as described in the following claims.

What I claim is:

1. A process for recovering hydrocarbons from a subterranean hydrocarbon-bearing formation which is penetrated by at least two wells having a communicating relationship, comprising in combination:

(a) initially injecting a heated fluid at relatively high pressures into said hydrocarbon formation by means of both wells for a relatively short period of time, sufficient to fluidize hydrocarbons therein and produce hydrocarbons upon cessation of said injection, but insufficient to result in fluid breakthrough;

(b) subsequently shutting in one well, and recovering hydrocarbons from the formation by means of the other well;

(c) selecting a minimum production rate from said other well whereby a relatively long production span is established;

(d) monitoring the production rate of said hydrocarbons from said other well;

(e) after said production rate declines to said minimum rate, along with reduced temperatures of the produced fluids, injecting additional heated fluid into said one well at relatively low pressures over a relatively long time span to create a driving force into the formation by means of said one well and continuing production of hydrocarbons from said other well while continuing said fluid drive but without breakthrough.

2. The process of claim 1 wherein the heated fluid injected into the formation by means of the previously shut-in injection well is at a pressure below the fracturing pressure of the formation.

3. The process of claim 1 wherein said fluids are steam.

4. The process of claim 1 wherein the temperature of said fluid is from 200° to 700° F.

5. The process of claim 1 wherein the injection pressure for said initially injected fluid is about 200 to 1500 psig and the pressure of said additional fluid is about 20 to 30% of that of said initially injected fluid.

* * * * *